US011289053B2

(12) United States Patent
Lou

(10) Patent No.: US 11,289,053 B2
(45) Date of Patent: Mar. 29, 2022

(54) METHOD FOR CORRECTING BRIGHTNESS OF DISPLAY PANEL AND APPARATUS FOR CORRECTING BRIGHTNESS OF DISPLAY PANEL

(71) Applicant: Yungu (Gu'an) Technology Co., Ltd., Langfang (CN)

(72) Inventor: Junhui Lou, Kunshan (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 17/106,784

(22) Filed: Nov. 30, 2020

(65) Prior Publication Data

US 2021/0082373 A1 Mar. 18, 2021

Related U.S. Application Data

(63) Continuation of application No. PCT/CN2019/091525, filed on Jun. 17, 2019.

(30) Foreign Application Priority Data

Dec. 29, 2018 (CN) ..... 201811637945.9

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0626* (2013.01);
(Continued)

(58) Field of Classification Search
CPC .... G09G 5/10; G09G 3/20; G09G 2320/0626; G09G 2354/00; G09G 2360/141; G09G 2360/144; G09G 2360/145
See application file for complete search history.

(56) References Cited

U.S. PATENT DOCUMENTS

2005/0280624 A1* 12/2005 Liu ..... G09G 3/3611 345/102
2007/0002130 A1 1/2007 Hartkop
(Continued)

FOREIGN PATENT DOCUMENTS

CN 102957934 A 3/2013
CN 103310752 A 9/2013
(Continued)

OTHER PUBLICATIONS

Office Action and Search Report dated May 26, 2020 in corresponding Chinese application No. 201811637945.9 20 pages including Machine-generated English-language translation.
(Continued)

*Primary Examiner* — Amare Mengistu
*Assistant Examiner* — Jennifer L Zubajlo
(74) *Attorney, Agent, or Firm* — Maier & Maier, PLLC

(57) ABSTRACT

The method for correcting brightness of a display panel includes: starting a brightness correction process according to a brightness correction starting instruction; obtaining a first curve representing a relationship between absolute values of input voltages of the transparent display area and light emitting brightness values of the transparent display area in a current state; recording the first curve as a relationship curve showing a relationship between absolute values of input voltages and light emitting brightness values of the transparent display area for correcting brightness; and adjusting an input voltage of the transparent display area according to the first curve, so that a front-side light emitting brightness value of the transparent display area is consistent with a light emitting brightness value of the non-transparent display area.

20 Claims, 9 Drawing Sheets

(52) U.S. Cl.
CPC ... *G09G 2354/00* (2013.01); *G09G 2360/141* (2013.01); *G09G 2360/144* (2013.01); *G09G 2360/145* (2013.01)

(56) References Cited

U.S. PATENT DOCUMENTS

| | | | | |
|---|---|---|---|---|
| 2016/0196793 | A1 | 7/2016 | Xu | |
| 2021/0150968 | A1* | 5/2021 | Chen | G09G 3/2007 |

FOREIGN PATENT DOCUMENTS

| | | | | |
|---|---|---|---|---|
| CN | 105094307 | A | | 11/2015 |
| CN | 106782306 | A | | 5/2017 |
| CN | 105096896 | B | | 11/2017 |
| CN | 107564470 | A | * | 1/2018 |
| CN | 107564470 | A | | 1/2018 |
| CN | 107665666 | A | | 2/2018 |
| CN | 108364957 | A | | 8/2018 |
| CN | 108510956 | A | | 9/2018 |
| CN | 108806586 | A | | 11/2018 |
| TW | 200501020 | A | | 1/2005 |

OTHER PUBLICATIONS

Office Action dated Jun. 18, 2020 in corresponding Taiwanese application No. 108123291; 11 pages including Partial English-language translation.
International Search Report dated Sep. 26, 2019 in corresponding International application No. PCT/CN2019/091525; 4 pages.
Written Opinion of the International Searching Authority dated Sep. 26, 2019 in corresponding International application No. PCT/CN2019/091525; 6 pages.

* cited by examiner

METHOD FOR CORRECTING BRIGHTNESS OF DISPLAY PANEL AND APPARATUS FOR CORRECTING BRIGHTNESS OF DISPLAY PANEL

CROSS REFERENCE TO RELATED APPLICATIONS

This application is a continuation application of International Application PCT/CN2019/091525 filed on Jun. 17, 2019, which claims priority to China Patent Application No. 201811637945.9 entitled "METHOD FOR CORRECTING BRIGHTNESS OF DISPLAY PANEL AND APPARATUS FOR CORRECTING BRIGHTNESS OF DISPLAY PANEL" and filed on Dec. 29, 2018, the disclosure of which is incorporated herein by reference in its entirety.

FIELD

The present application relates to the field of display, and in particular, to methods for correcting brightness of a display panel and apparatuses for correcting brightness of a display panel.

BACKGROUND

With the rapid development of display terminals, users have increasingly higher requirements on a screen-to-body ratio, so that full-screen displaying of the display terminals has received more and more attention from industry. For a display terminal such as a mobile phone and a tablet computer, because a front camera, an earphone, an infrared sensing element, etc. need to be integrated therein, a notched area of its display panel like a notch area or a hole area cannot be used to display pictures. With respect to electronic devices realizing a camera function, outside light may enter a photosensitive element placed below a display panel through a hole on the display panel. However, these electronic devices are not real full screens, and pictures cannot be displayed in all areas of entire display panel. For example, the pictures cannot be displayed in a camera area of the display panel.

SUMMARY

An object of the present application is to provide a method for correcting brightness and an apparatus for correcting brightness for a full-screen display panel to enable the display brightness of a transparent display area and the display brightness of a non-transparent display area to be consistent.

In order to achieve the above object, the present application provides a method for correcting brightness of a display panel. The display panel includes: a transparent display area; and a non-transparent display area. The transparent display area is a double-sided light emitting display area. A front side of the transparent display area is a side close to ambient light. A back side of the transparent display area is a side away from the ambient light. The method for correcting brightness includes: starting a brightness correction process according to a brightness correction starting instruction; obtaining a first curve representing a relationship between absolute values of input voltages of the transparent display area and light emitting brightness values of the transparent display area in a current state; recording the first curve as a relationship curve showing a relationship between absolute values of input voltages and light emitting brightness values of the transparent display area for correcting brightness; and adjusting an input voltage of the transparent display area according to the first curve, so that a front-side light emitting brightness value of the transparent display area is consistent with a light emitting brightness value of the non-transparent display area, or the front-side light emitting brightness value of the transparent display area is restored to a factory default brightness value.

The present application also provides a method for correcting brightness of a display panel. The display panel includes: a transparent display area; and a non-transparent display area. The transparent display area is a double-sided light emitting display area. A front side of the transparent display area is a side close to ambient light. A back side of the transparent display area is a side away from the ambient light. The method for correcting brightness includes: starting a brightness correction process according to a brightness correction starting instruction; obtaining a current working time length of the display panel and/or current brightness attenuation state of the display panel; determining a first data relationship corresponding to the current working time length of the display panel from a pre-stored first data relationship set and/or a second data relationship corresponding to the current brightness attenuation state of the display panel from a pre-stored second data relationship set; recording the first data relationship and/or the second data relationship as a correspondence between an absolute value of an input voltage and a light emitting brightness value of the transparent display area for correcting brightness, wherein the first data relationship set is a set of pre-stored correspondences between absolute values of input voltages and light emitting brightness values of the transparent display area in different working time length ranges of the display panel, and the second data relationship set is a set of pre-stored correspondences between the absolute values of the input voltages and the light emitting brightness values of the transparent display area in different attenuation state ranges of the display panel; and adjusting an input voltage of the transparent display area according to the first data relationship and/or the second data relationship, so that a front-side light emitting brightness value of the transparent display area is consistent with a light emitting brightness value of the non-transparent display area, or the front-side light emitting brightness value of the transparent display area is restored to a factory default brightness value.

The present application also provides an apparatus for correcting brightness of a display panel. The display panel includes: a transparent display area; and a non-transparent display area. The transparent display area is a double-sided light emitting display area. A front side of the transparent display area is a side close to ambient light. A back side of the transparent display area is a side away from the ambient light. The apparatus for correcting brightness includes: a starting module configured to start a brightness correction process according to a brightness correction starting instruction; a first curve obtaining module configured to obtain a first curve representing a relationship between absolute values of input voltages of the transparent display area and light emitting brightness values of the transparent display area in a current state; a first storing module configured to store the first curve; an updating module configured to record the first curve as a relationship curve showing a relationship between absolute values of input voltages and light emitting brightness values of the transparent display area for correcting brightness; and a correcting module configured to adjust the input voltage of the transparent display area according to the first curve, so that a front-side light emitting brightness value of the transparent display area is consistent with a light emitting brightness value of the non-transparent display area, or the front-side light emitting brightness value of the transparent display area is restored to a factory default brightness value.

DETAILED DESCRIPTION

In order to make the above objects, features and advantages of the present application more apparent and understandable, specific examples of the present application will be described in detail below with reference to the drawings.

Figure 1:
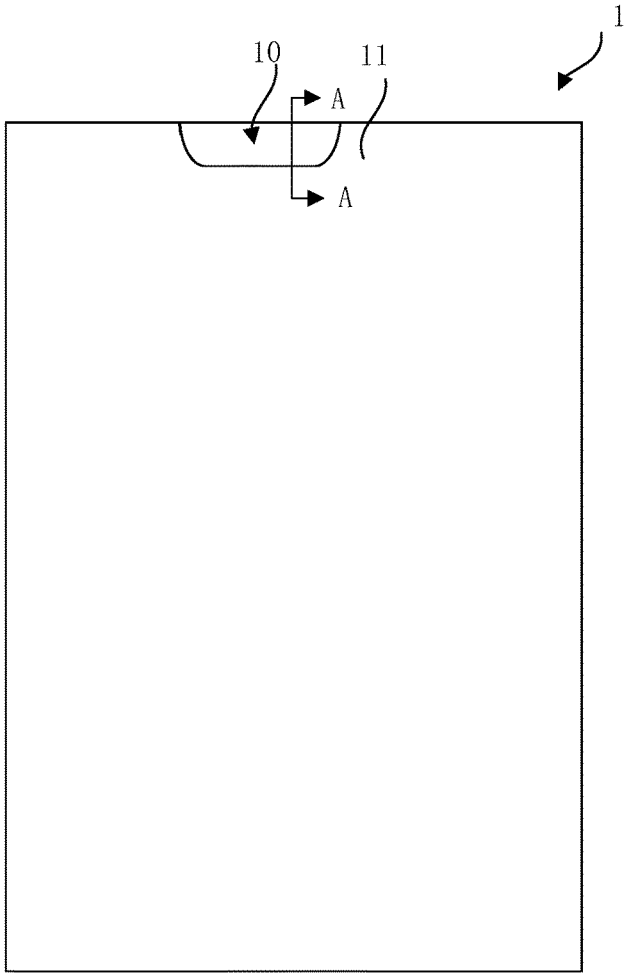
FIG. 1 is a top view illustrating an example of a display panel according to the present application.
Figure 2:
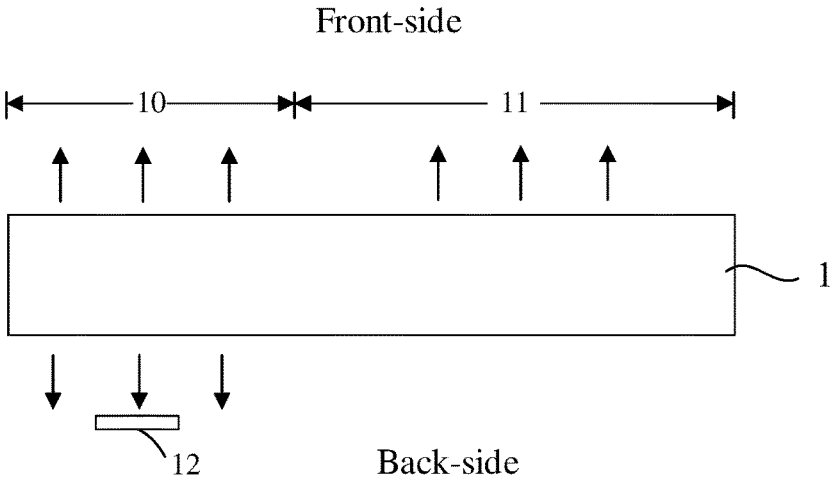
FIG. 2 is a schematic view illustrating light emission of a transparent display area and a non-transparent display area according to the present application, which corresponds to a sectional view along a straight-line A-A in FIG. 1.

FIG. 1 is a top view illustrating a display panel according to an example of the present application. FIG. 2 is a schematic view illustrating a light emitting manner of the display panel in FIG. 1.

Examples of the present application are directed to real full-screen display panels and display devices. The display device in the present application may be a display panel, or a display device or a display terminal including the display panel. The display panel in this application includes a transparent display area 10 and a non-transparent display area 11. The transparent display area is a double-side light emitting display area. A front side of the transparent display area 10 is a side close to ambient light, and a back side of the transparent display area 10 is a side away from the ambient light. As shown in FIGS. 1 and 2, the display panel in the present application does not have a notched area. A display panel, i.e., the transparent display area 10 in the present application, is also provided with a photosensitive element, a camera or other element of the display device. Through the transparent display area 10, an area above the photosensitive element and/or the camera of the display device may also display a normal picture together with the non-transparent display area 11, and when the camera is working, the transparent display area 10 does not display a picture, but allow light to pass through normally to ensure the realization of functions such as photography and videography.

Based on the display panel in this application, since the transparent display area 10 is a double-side light emitting display area, and the non-transparent display area 11 is a single-side light emitting display area, this makes attenuation rates of light emitting materials in the two areas different. That is, after the display panel works for a period of time, a light emitting brightness value of the transparent display area 10 will be gradually lower than a light emitting brightness value of the non-transparent display area 11, resulting in different light emitting brightness of the two areas. Therefore, the light emitting brightness value of the transparent display area 10 needs to be corrected in order to ensure the display effect of a full screen.

Figure 3:
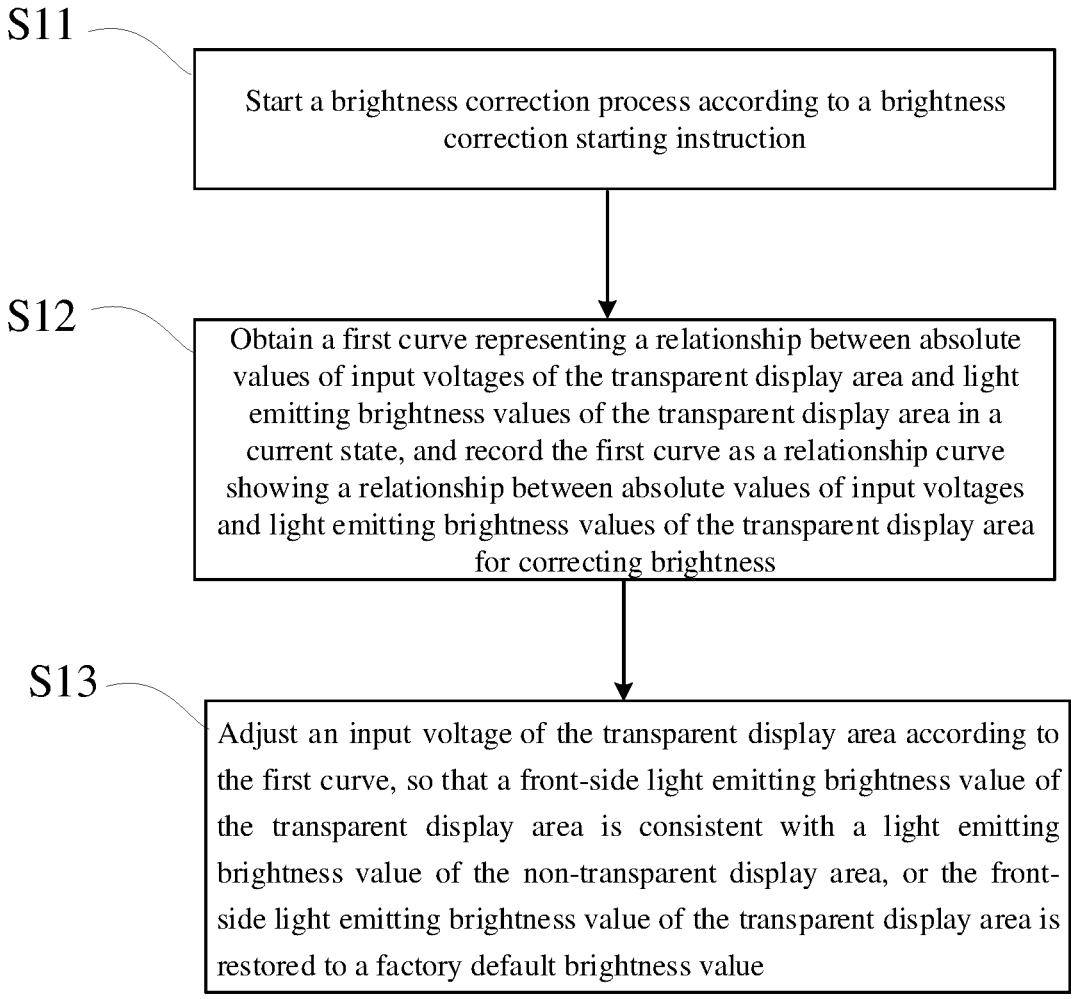
FIG. 3 is a schematic flowchart illustrating an example of a method for correcting brightness of a display panel according to the present application.

Based on this, the present application provides a method for correcting brightness of a display panel. As shown in FIG. 3, the brightness correction method includes step S11 to step S13.

At step S11, a brightness correction process is started according to a brightness correction starting instruction.

The brightness correction starting instruction is started or triggered when a brightness correction command is received, and then the brightness correction process is started. The brightness correction starting instruction may be generated according to the user's requirement, or automatically started by the display panel.

At step S12, a first curve representing a relationship between absolute values of input voltages of the transparent display area and light emitting brightness values of the transparent display area in a current state is obtained, and the first curve is recorded as a relationship curve showing a relationship between absolute values of input voltages and light emitting brightness values of the transparent display area for correcting brightness.

Due to different types of driving transistors in a pixel driving circuit of the display panel, positives and negatives of input voltages (i.e., Vdata) are different. If the driving transistors are P-type transistors, the Vdata is a negative voltage. If the driving transistors are N-type transistors, the Vdata is a positive voltage.

Figure 4:
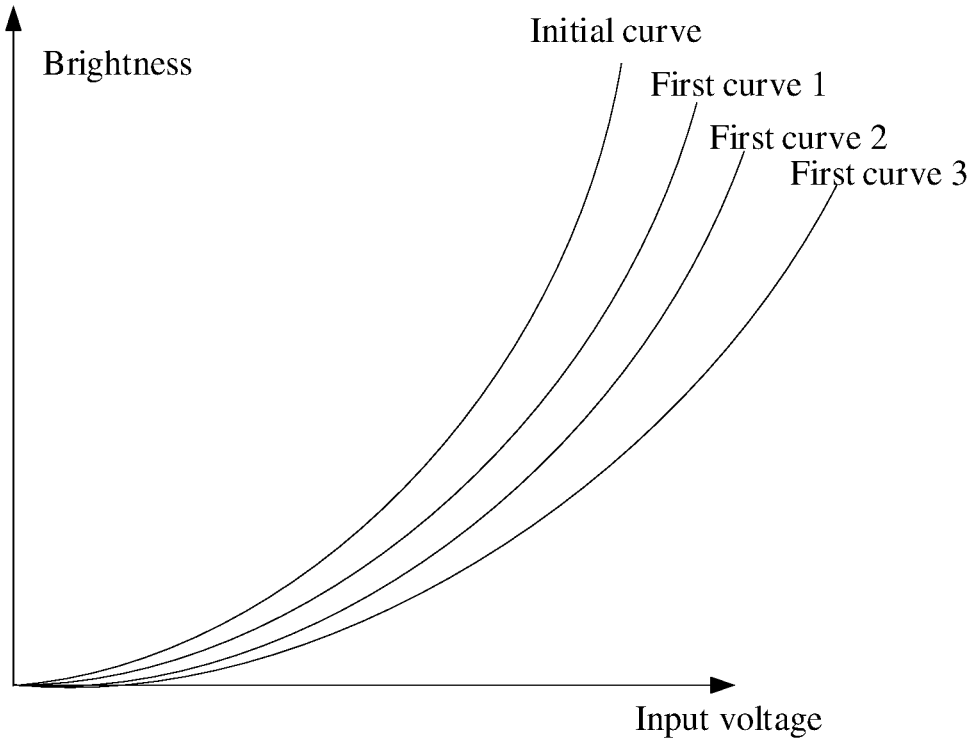
FIG. 4 is a schematic diagram illustrating first curves in a method for correcting brightness of a display panel according to the present application.

In this example, the first curve may be a gamma curve, or a two-dimensional relationship curve showing a relationship between input voltages and light emitting brightness values of the transparent display area. As shown by an initial curve and first curves 1, 2, 3 in FIG. 4, corresponding first curves in different attenuation states of the display panel are different. That is to say, in a life cycle of a display panel, there are a plurality of first curves. FIG. 4 illustrates only the initial curve and three of the first curves, i.e., the first curves 1, 2, 3. The step S12 is a process of updating a curve for correcting brightness in the transparent display area.

The manner for obtaining the first curve in this example may include the followings. A first curve is generated by collecting light emitting brightness values of the display panel using the photosensitive element below the display panel; or based on a factory default first curve set, according to an attenuation state of the display panel, a first curve corresponding to the attenuation state in the first curve set is determined; or, according to a working time length of the display panel, a first curve corresponding to the working time length in the first curve set is determined.

Specifically, as can be known from a change in the first curves shown in FIG. 4, with the extension of working time length of the transparent display area, the light emitting material in this area attenuates, and an absolute value of required Vdata corresponding to a same light emitting brightness value increases. In this example, obtaining a Vdata value in the first curve in the current state is increasing an absolute value of Vdata corresponding to a light emitting brightness value in a first curve used at a previous time to a voltage whose corresponding light emitting brightness value is consistent with that of the non-transparent display area. Compared to a process of obtaining Vdata values by adjusting the first curves before the display panel leaves a factory, the process of obtaining the Vdata value in the first curve in the current state has a clear adjustment direction, and the adjustment process is more simple and faster.

At step S13, the input voltage of the transparent display area is adjusted according to the first curve, so that a front-side light emitting brightness value of the transparent display area is consistent with a light emitting brightness value of the non-transparent display area, or the front-side light emitting brightness value of the transparent display area is restored to a factory default brightness value.

By adjusting the input voltage of the transparent display area according to the first curve, the light emitting brightness value of the transparent display area is consistent with the light emitting value of the non-transparent display area, the difference in brightness between the transparent display area 10 and the non-transparent display area 11 due to different attenuation degrees of components is reduced or eliminated, and thereby display effect is improved.

It is noted that the front-side light emitting brightness value of the transparent display area being consistent with the light emitting brightness value of the non-transparent display area shall include such cases: a ratio of the front-side light emitting brightness value of the transparent display area to the light emitting brightness value of the non-transparent display area is in a range of 90%-110%. Within this range, human eyes cannot perceive the difference between the front-side light emitting brightness value of the transparent display area and the light emitting brightness value of the non-transparent display area. For user perception, in this case, the front-side light emitting brightness value of the transparent display area is consistent with the light emitting brightness value of the non-transparent display area.

Figure 5:
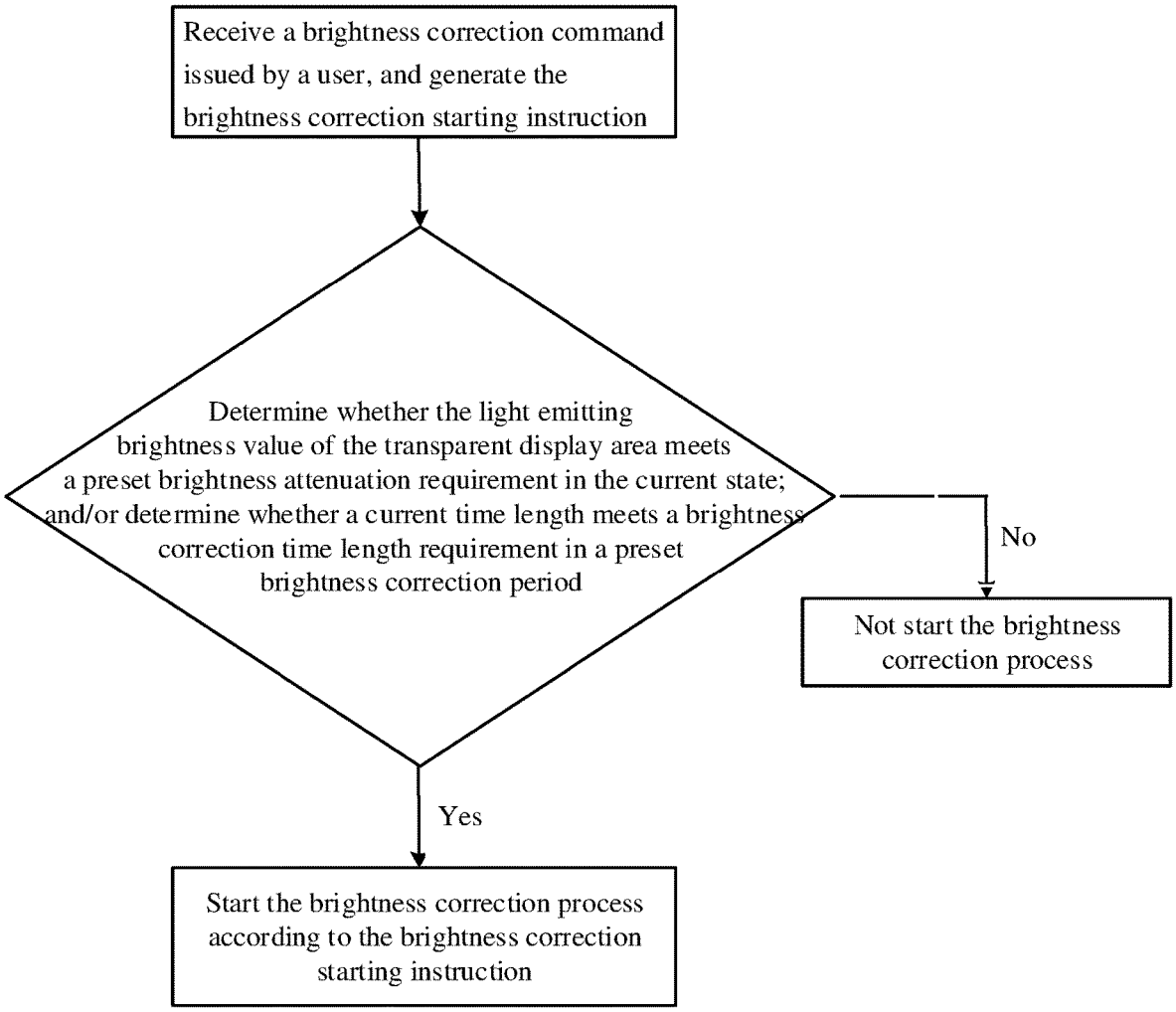
FIG. 5 is a schematic flowchart illustrating manual triggering of a brightness correction starting instruction in a method for correcting brightness of a display panel according to the present application.

In an example, the brightness correction command may be manually triggered. FIG. 5 is a schematic flowchart illustrating manual triggering of a brightness correction starting instruction in an example. In this example, before starting the brightness correction process according to the brightness correction starting instruction, that is, before the S11, a brightness correction command issued by a user is received. When the user perceives that there exists a significant difference in brightness between the transparent display area 10 and the non-transparent display area 11, the user may trigger the brightness correction command Optionally, an interface and a corresponding link for triggering the brightness correction command are provided in an application program or a system instruction.

However, in actual application of a display panel 1, there exists a possibility of user misoperation. That is, a user inadvertently opens a brightness correction command interface and accidentally touches a link for generating brightness correction command, so that it is necessary to determine whether the light emitting brightness value of the transparent display area is to be corrected before the brightness correction process is started.

Specifically, in this example, after receiving the brightness correction command issued by the user, and generating the brightness correction starting instruction, the method for correcting brightness further includes the following steps. Whether the light emitting brightness value of the transparent display area meets a preset brightness attenuation requirement in the current state is determined; and if the light emitting brightness value of the transparent display area meets the preset brightness attenuation requirement, the brightness correction process is started according to the brightness correction starting instruction. Optionally, current actual light emitting brightness values of the transparent display area may be obtained by detecting through the photosensitive element below the transparent display area, and the actual light emitting brightness values are compared with one or more preset brightness values. If a difference between an actual light emitting brightness value and a corresponding present brightness value exceeds a preset threshold, it is determined that the preset brightness attenuation requirement is met, and the brightness correction process is started according to the brightness correction starting instruction. Otherwise, it is determined that the preset brightness attenuation requirement is not met, and there is no need to start the brightness correction process.

The preset brightness values may be one or more prestored initial brightness values of the display panel under one or some test Vdata values. Specifically, by inputting one or some test Vdata values for the transparent display area in the current state, current light emitting brightness values under these Vdata values may be obtained, and a current light emitting brightness value may be compared with a corresponding preset brightness value.

In addition to determining whether the light emitting brightness value of the transparent display area meets the preset brightness attenuation requirement, whether the brightness correction process is to be started may be determined by determining whether a working time length of the transparent display area meets a brightness correction time length requirement. In an example, after receiving the brightness correction command issued by the user, and generating the brightness correction starting instruction, the method for correcting brightness further includes the following steps. Whether a current time length meets a brightness correction time length requirement in a preset brightness correction period is determined; and if the current time length meets the brightness correction time length requirement, the brightness correction process is started according to the brightness correction starting instruction. The current time length may be determined according to cumulative working time length of the display panel (a time length of the display panel being lighted). The brightness correction period may also be determined by a time length of the display panel leaving a factory (calculated from leaving the factory, regardless of whether the display panel is lighted). The brightness correction period may also be calculated from a time when the display panel is lighted for the first time after leaving the factory. After a certain time length, brightness correction may be started. For example, the brightness correction period is set to cumulative working time length of every 100 hours, or the brightness correction period may be set to a time length of 2 months after leaving the factory. The time of the brightness correction period may be set according to an average attenuation period of the display panels, or it may be set by a user himself/herself. In this example, it is preferably set uniformly before leaving the factory. The specific period is not limited in this example.

The brightness attenuation degree and the brightness correction period may be determined simultaneously or at different times. The brightness correction process may be started when one of the brightness attenuation degree and the brightness correction period meets a brightness correction requirement. The brightness correction process may also be started when both of the brightness attenuation degree and the brightness correction period meet the brightness correction requirement. Specific way of determination may be selected according to needs of manufacturers. In this example, it is preferable that satisfying the brightness correction requirement concerning the brightness attenuation degree is used as a primary standard, and satisfying the brightness correction requirement concerning the time length requirement is a secondary standard. In actual operations, the working time length may be determined firstly, and then the brightness attenuation degree is determined, thereby CPU resources is saved.

Under normal circumstances, for a display device or a display panel, a number of adjusting a gamma curve when leaving the factory is limited, and the number of adjusting the gamma curve has been set when leaving the factory, and cannot be increased later. Therefore, determining whether the brightness correction requirement is met may avoid a waste of the number of adjusting the gamma curve in the case of user misoperation or the like.

If neither of the brightness attenuation degree and the brightness correction period of the transparent display area meet the brightness correction requirement, whether there exists abnormity in output voltages within a certain time is to be checked. If there exists the voltage abnormity, the voltages are adjusted in order to eliminate the voltage abnormity. If there no voltage abnormity exists, the brightness correction command issued by the user may be a misoperation, and thereby no brightness correction is required. Information indicating that no brightness correction is required may be fed back to the user. The voltage abnormity may cause phenomena that the brightness of the display panel is unstable and flickering or decreases intermittently. Optionally, in this case, the voltages may be adjusted through software design so that they tend to be stable.

The brightness correction command issued by the user is a brightness correction command issued by operating a brightness correction icon on a display interface of the display panel by the user. For example, the brightness correction command is issued by clicking a brightness correction icon on a touch interface of a touch screen by the user. The user may also issue a brightness correction command through a voice input or a gesture input. The user may also issue a brightness correction command through biological recognition such as fingerprint recognition, iris recognition or facial recognition.

Figure 6:
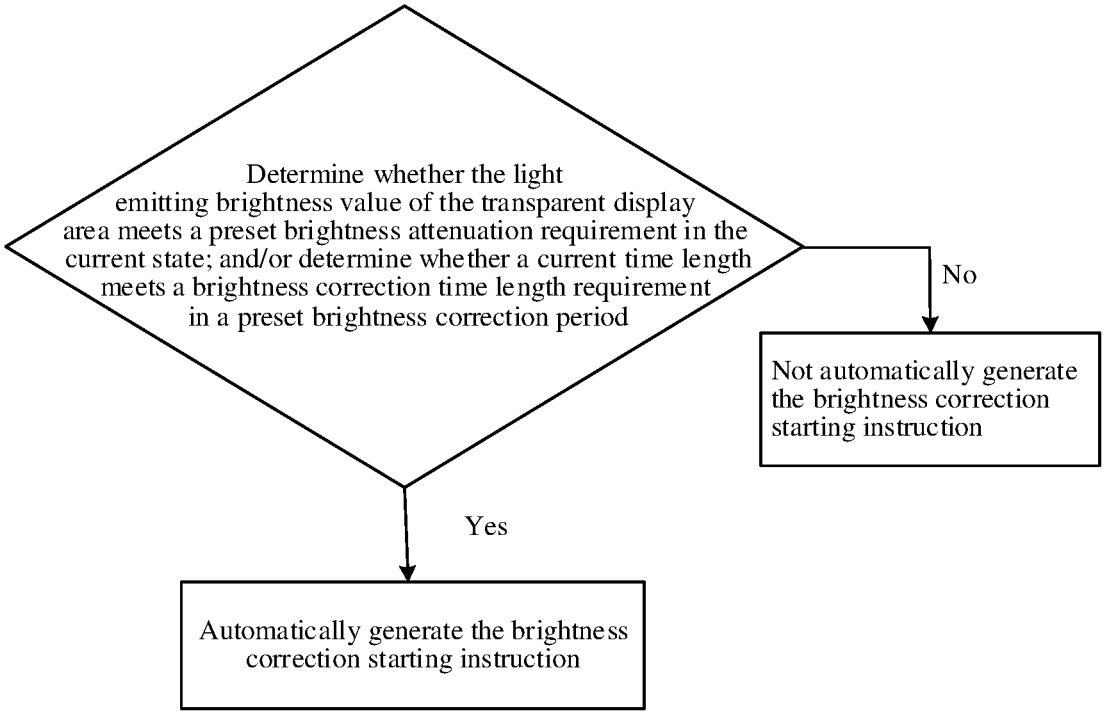
FIG. 6 is a schematic flowchart illustrating automatic triggering of a brightness correction starting instruction in a method for correcting brightness of a display panel according to the present application.

In other example, the brightness correction process may be started automatically. For example, automatic starting time and conditions for brightness correction process are set before the display panel leaves the factory. FIG. 6 is a schematic flowchart illustrating automatic triggering of a brightness correction starting instruction. Before starting the brightness correction process according to the brightness correction starting instruction, the method for correcting brightness further includes the following steps. Whether the light emitting brightness value of the transparent display area in the current state meets a preset brightness attenuation requirement is determined; if the light emitting brightness value of the transparent display area meets the preset brightness attenuation requirement, the brightness correction starting instruction is automatically generated; if the light emitting brightness value of the transparent display area does not meet the preset brightness attenuation requirement, the brightness correction starting instruction is not automatically generated.

Optionally, before starting the brightness correction process according to the brightness correction starting instruction, the method for correcting brightness further includes the following steps. Whether a current time length meets a brightness correction time length requirement in a preset brightness correction period is determined; and if the current time length meets the brightness correction time period requirement, the brightness correction starting instruction is automatically generated. Similarly, the current time length may be determined by a cumulative working time length of the display panel, or by a time length of the display panel leaving a factory (calculated from leaving the factory or from being lighted for the first time after leaving the factory, regardless of whether it is working). For example, the brightness correction period is set to be a period of time that the same first curve is being used and after which the above two determination processes are started. For example, after the cumulative working time length of the display panel is up to 100 hours, 200 hours, 300 hours or 500 hours, the above two determination processes are started, and so on. The specific setting of the brightness correction period is not limited in this example.

Similar to examples in which brightness correction process is started according to user needs, in automatically starting the brightness correction process in this example, the brightness attenuation degree and the brightness correction period of the transparent display area may be determined simultaneously or at different times. The brightness correction starting instruction is automatically generated when one of the brightness attenuation degree and the brightness correction period meets the brightness correction requirement. The brightness correction starting instruction may also be automatically generated when both of the brightness attenuation degree and the brightness correction period meet the brightness correction requirement. Specific way of determination may be selected according to actual situations.

Since the above examples relate to the attenuation degree of the light emitting brightness value, that is, the light emitting brightness value needs to be collected. It is necessary to consider the influence of ambient light so as to improve the accuracy of determining the attenuation degree.

In an example, before generating the brightness correction starting instruction, the brightness correction method further includes the following steps. An intensity of the ambient light is determined; and if the intensity of the ambient light is lower than a preset threshold, the brightness correction starting instruction is generated. Optionally, the intensity of ambient light at night is selected as the preset threshold. For example, the preset threshold is set to the intensity of the ambient light collected at 01:00 Beijing time in an environment without moonlight and illuminating lamps.

In addition, in a case where the brightness correction process is automatically started, the brightness correction process may be staggered from a time when a user uses the display panel. That is to say, brightness correction for the transparent display area is automatically performed when the user does not use the display panel.

In an example, before generating the brightness correction starting instruction, the brightness correction method further includes the following steps. Whether a current time is an inactive time of user is determined; and if the current time is the inactive time of user, the brightness correction starting instruction is automatically generated. Optionally, according to user habits, for example, a user's sleep cycle is from 23:00 pm to 6:00 am in the morning of next day, a processor or a chip may record this period of time as an inactive time of user. Preferably, the inactive time is a period of time after a sleep time of the display panel exceeds a preset threshold, and/or the inactive time is a preset fixed period of time, so as to ensure that the brightness correction starting instruction is automatically generated during the inactive time, and the normal use of the display panel by the user is not affected.

The first curve representing the relationship between the absolute values of the input voltages of the transparent display area and the light emitting brightness values of the transparent display area may change due to reasons at a software level or a hardware level. In an example, before starting the brightness correction process according to the brightness correction starting instruction, the method for correcting brightness further includes the following steps. Whether a first curve representing a relationship between current input voltages of the transparent display area and light emitting brightness values of the transparent display area in the current state is to be corrected is determined; and if the first curve is to be corrected, the brightness correction process is started. For the two manners of manually generating a brightness correction command and automatically generating a brightness correction starting instruction, such a determination may be made for the first curve of the transparent display area.

In an example, determining whether the first curve representing the relationship between the absolute values of the input voltages of the transparent display area and the light emitting brightness values of the transparent display area in the current state is to be corrected specifically includes the following steps.

Reference brightness values corresponding to respective input voltages of the transparent display area at least in high-order, middle-order and low-order grayscale display states are obtained. In order to ensure the accuracy of determination, reference brightness values corresponding to respective input voltages of the transparent display area in more grayscale display states may also be obtained.

According to a currently recorded relationship curve representing the relationship between absolute values of input voltages and light emitting brightness values of the transparent display area, whether one or more of differences between the reference brightness values corresponding to each of the respective input voltages and light emitting brightness values corresponding to each corresponding one of the respective input voltages in the relationship curve exceed a preset threshold is determined; and if one or more of the differences exceed the preset threshold, the first curve is to be corrected.

In order to simplify the structure of the display panel, the light emitting brightness value of the transparent display area 10 required in the brightness correction process is a back-side light emitting brightness value of the transparent display area 10. That is, the back-side light emitting brightness value of the transparent display area may be obtained through a camera or other photosensitive element disposed originally below the transparent display area 10. The cost may be reduced while the structure is simple. In another example, the light emitting brightness value of the transparent display area 10 is a front-side light emitting brightness value of the transparent display area 10. At this time, an optical sensor may be separately disposed to detect front-side light emitting brightness values.

Correspondingly, the first curve is a curve representing a relationship between the absolute values of the input voltages of the transparent display area and the back-side light emitting brightness values of the transparent display area.

Specifically, the obtaining of the first curve representing the relationship between the absolute values of the input voltages of the transparent display area and the light emitting brightness values of the transparent display area in the current state includes the following steps. Different input voltages are applied to pixels in the transparent display area, and the back-side light emitting brightness values of the transparent display area under the different input voltages are obtained using the photosensitive element so as to obtain the first curve.

The photosensitive element may be a camera or another light sensing element. The photosensitive element may directly obtain brightness data, unlike the camera which takes pictures and then performs image processing to obtain light emitting brightness value data. In an example, obtaining the back-side light emitting brightness values of the transparent display area under the different input voltages using the photosensitive element includes the following steps. Brightness images of the back side of the transparent display area are obtained by taking pictures of the back side of the lighted transparent display area using the photosensitive element; and the back-side light emitting brightness values of the transparent display area under the different input voltages are obtained by analyzing the brightness images, for example, by performing a contrast analysis.

Another manner for obtaining the first curve will be introduced below. In an example, the obtaining of the first curve representing the relationship between the absolute values of the input voltages of the transparent display area and the light emitting brightness values of the transparent display area in the current state includes the following steps.

A current working time length and/or a current brightness attenuation state of the display panel are obtained.

A first curve corresponding to the current working time length and/or the current brightness attenuation state of the display panel is determined from a pre-stored first curve set, where the first curve set is a set of first curves representing relationships between absolute values of input voltages of the transparent display area and the light emitting brightness values of the transparent display area in different attenuation states and corresponding to working time lengths of the display panel. The working time length may be a time length of the display panel starting to display normally after leaving the factory, that is, a time length of a display screen in a lighted state.

The first curve set may be pre-stored in a driving chip of the display panel. In an example, the first curve set is obtained according to an attenuation period and an attenuation state of a light emitting material in the transparent display area before the display panel leaves the factory.

For example, a certain number of display panels are selected from a batch of display panels. The first curves representing the relationship between the absolute values of the input voltages and the light emitting brightness values of the transparent display area are determined and calculated through experiments, and a brightness attenuation value may also be used as a keyword to facilitate search. Each display panel corresponds to one first curve so as to quickly obtain a set of first curves. The manner for selection may be random sampling so that the obtained set of first curves is more complete and more comprehensive.

In addition to directly correcting the overall light emitting brightness value of the transparent display area, light emitting brightness value of each sub-pixel of the transparent display area may be individually corrected. Pixels in the transparent display area include sub-pixels in n colors, where n is a positive integer. The first curve set includes first curve subsets corresponding to the sub-pixels in the n colors respectively. That is to say, the first curve set includes first curve subsets respectively corresponding to the sub-pixels in the n colors, and when brightness correction is performed on a sub-pixel, a first curve corresponding to the sub-pixel is determined from a corresponding first curve subset.

The obtaining of the first curve representing the relationship between the absolute values of the input voltages of the transparent display area and the light emitting brightness values of the transparent display area in the current state includes the following steps. Input voltages are simultaneously applied to the sub-pixels in the n colors in the transparent display area to obtain a plurality of first curves of sub-pixels respectively corresponding to one color of the n colors in a white picture, where n is a positive integer. That is to say, first curves of sub-pixels in various colors are obtained to adjust light emitting brightness values of the sub-pixels in various colors respectively.

Alternatively, the obtaining of the first curve representing the relationship between the absolute values of the input voltages of the transparent display area and the light emitting brightness values of the transparent display area in the current state includes the following steps. Input voltages are applied to sub-pixels in $n^{th}$ color in the transparent display area, to make the transparent display area displays a picture showing the $n^{th}$ color; and a first curve corresponding to the sub-pixels in the $n^{th}$ color under the $n^{th}$ color picture is obtained in an obtaining curve process, and the obtaining curve process is repeated until all first curves corresponding to the sub-pixels in the n colors are obtained. That is to say, since the first curves of the sub-pixels in various colors are obtained respectively, the obtained first curves are more accurate. Since light emitting brightness values of the sub-pixels in various colors are corrected simultaneously, the display effect of the transparent display area after brightness correction is more excellent.

Optionally, n=3, the pixels in the transparent display area include sub-pixels in first color, sub-pixels in second color and sub-pixels in third color, and the sub-pixels in first color, the sub-pixels in second color and the sub-pixels in third color are R sub-pixels, G sub-pixels and B sub-pixels, respectively. Alternatively, n=4, the pixels in the transparent display area include R sub-pixels, G sub-pixels, B sub-pixels and Y sub-pixels. The type and number of sub-pixels in different colors in a same pixel unit of the transparent display area are not limited in this example.

As described above, since the obtaining of the back-side light emitting brightness value of the transparent display area 10 has advantages in structure and cost, in an example, based on a pre-stored ratio of the front-side light emitting brightness value to the back-side light emitting brightness value of the transparent display area, and the light emitting brightness value of the non-transparent display area in the current state, a first back-side light emitting brightness value of the transparent display area may be obtained. The ratio of the front-side light emitting brightness value to the back-side light emitting brightness value in a same transparent display area, under different input voltages, is unique. A first input voltage corresponding to the first back-side light emitting brightness value is determined according to the first curve. The first input voltage is provided for a data line of the transparent display area, so that the front-side light emitting brightness value of the transparent display area is consistent with the light emitting brightness value of the non-transparent display area, or the front-side light emitting brightness value of the transparent display area is restored to the factory default brightness value. In this way, the difference in light emitting brightness between the transparent display area and the non-transparent display area is reduced or eliminated, and the display effect is improved.

Since each film layer of the transparent display area is determined, and influences of component attenuation on the front-side light emitting brightness value and the back-side light emitting brightness value correspond to each other, the ratio of the front-side light emitting brightness value to the back-side light emitting brightness value of the transparent display area is always unique.

In another example, the present application also provides another method for correcting brightness of a display panel. Different from the above examples, in this example, after the brightness correction process is started, an attenuation state of current light emitting brightness instead of the first curve is obtained. Moreover, according to attenuation situations of the light emitting material in the transparent display area after working for different time lengths, and in certain attenuation states, a Vdata value (or a gamma curve) required to achieve initial display brightness is obtained, where the Vdata values required to achieve initial display brightness under certain attenuation states are pre-stored in a system before the display panel leaves the factory. In this example, only the Vdata value is taken as an example for illustration. Therefore, it is only necessary to directly invoke the pre-stored Vdata value according to the working time length or attenuation state of the transparent display area, and input corresponding Vdata into the transparent display area. The manner in this example reduces the calculation pressure of CPU in the correction process.

Figure 7:
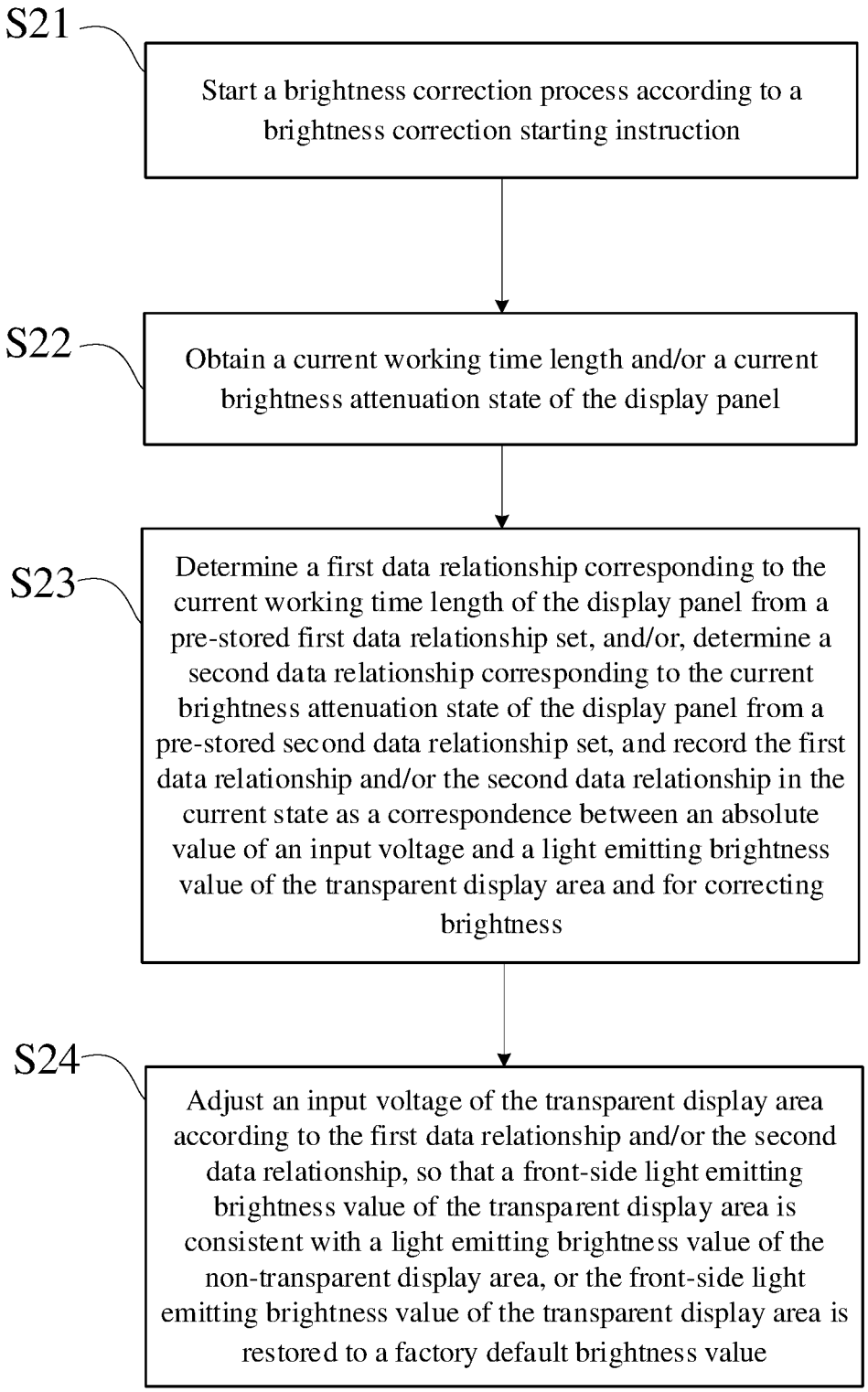
FIG. 7 is a schematic flowchart illustrating another example of a method for correcting brightness of a display panel according to the present application.

Referring to FIG. 7, the present application also provides a method for correcting brightness of a display panel. The display panel may be the display panel 1 as shown in FIGS. 1 and 2. The method for correcting brightness includes steps S21-S24.

At S21, a brightness correction process is started according to a brightness correction starting instruction.

Similar to the above examples, the brightness correction starting instruction may be triggered manually or automatically.

At S22, a current working time length and/or a current brightness attenuation state of the display panel are/is obtained.

For the working time length and the current brightness attenuation state, it is possible to select one or both of them.

At S23, a first data relationship corresponding to the current working time length of the display panel is determined from a pre-stored first data relationship set, and/or, a second data relationship corresponding to the current brightness attenuation state of the display panel is determined from a pre-stored second data relationship set; the first data relationship and/or the second data relationship in a current state are/is recorded as a correspondence between an absolute value of an input voltage and a light emitting brightness value of the transparent display area for correcting brightness. The first data relationship set is a set of pre-stored correspondences between absolute values of input voltages and the light emitting brightness values of the transparent display area in different working time length ranges of the display panel, and the second data relationship set is a set of pre-stored correspondences between the absolute values of the input voltages and the light emitting brightness values of the transparent display area in different attenuation state ranges of the display panel.

The first data relationship set and the second data relationship set are equivalent to a plurality of discrete points on the first curve, and each point corresponds to one first data relationship and/or second data relationship.

At S24, an input voltage of the transparent display area is adjusted according to the first data relationship and/or the second data relationship, so that a front-side light emitting brightness value of the transparent display area is consistent with a light emitting brightness value of the non-transparent display area, or the front-side light emitting brightness value of the transparent display area is restored to a factory default brightness value.

In this way, the difference in brightness between the transparent display area 10 and the non-transparent display area 11 due to different attenuation degrees of components may be reduced or eliminated, and thereby, the display effect is improved. It is understandable that the higher density of data relationships in the first data relationship set and the second data relationship set is, the more accurate the brightness correction is.

Similar to the first curve in the above examples, before the display panel leaves a factory, the first data relationship set and the second data relationship set are obtained according to an attenuation period and an attenuation state of a light emitting material in the transparent display area. Optionally, attenuation periods and attenuation states of a plurality of display panels in the same batch are obtained. Taking an attenuation period as an example, a brightness attenuation value of a display panel within the attenuation period, an input voltage corresponding to the brightness attenuation value, and an attenuation time length are recorded, so that a plurality of first data relationships in the first data relationship set are obtained.

In order to further improve the accuracy of correction, in an example, the first data relationship set and the second data relationship set include correspondences between absolute values of respective input voltages and corresponding light emitting brightness values of the transparent display area at least in high-order, middle-order and low-order grayscale display states. Optionally, the obtaining of the correspondences between the absolute values of the input voltages and corresponding light emitting brightness values in multiple grayscale display states may improve the accuracy of brightness correction.

Similar to the above examples, pixels in the transparent display area include sub-pixels in n colors, where n is a positive integer. The first data relationship set and the second data relationship set include correspondences between absolute values of respective input voltages and light emitting brightness values corresponding to the sub-pixels in respective colors under a display picture in each color.

In an example, n=3, the pixels in the transparent display area include sub-pixels in first color, sub-pixels in second color and sub-pixels in third color. The sub-pixels in first color, the sub-pixels in second color and the sub-pixels in third color are, but not limited to, R sub-pixels, G sub-pixels and B sub-pixels, respectively. In an example, n=4, for example, Y sub-pixels is added on the basis of the R sub-pixels, G sub-pixels and B sub-pixels.

The first data relationship set may include first data relationships corresponding to n colors, respectively. The determining of the first data relationship corresponding to the current working time length of the display panel from the pre-stored first data relationship set includes the following step. The first data relationships corresponding to the current working time length of the display panel and respectively corresponding to sub-pixels in $n^{th}$ color are determined from the pre-stored first data relationship set.

The determining of the second data relationship corresponding to the current brightness attenuation state of the display panel from the pre-stored second data relationship set includes the following step. The second data relationships corresponding to the current brightness attenuation state of the display panel and respectively corresponding to sub-pixels in $n^{th}$ color sub-pixel are determined from the pre-stored second data relationship set.

For example, the current working time length is used as a search term for search or determination. Since the first data relationship set is a discrete-type data relationship set. It is also possible to use a value close to the current working time length for search to quickly obtain the first data relationship. The search in the second data relationship set is similar to the search in the first data relationship set, and their difference lies in that the search is performed through the attenuation state of the transparent display area.

Since the brightness of pixels in n colors is corrected respectively, as compared to correction on overall brightness, the light emitting brightness value after correction on brightness of the transparent display area is more accurate (or closer to actual brightness of the non-transparent display area), the difference in brightness between the transparent display area 10 and the non-transparent display area 11 is further reduced.

Figure 8:
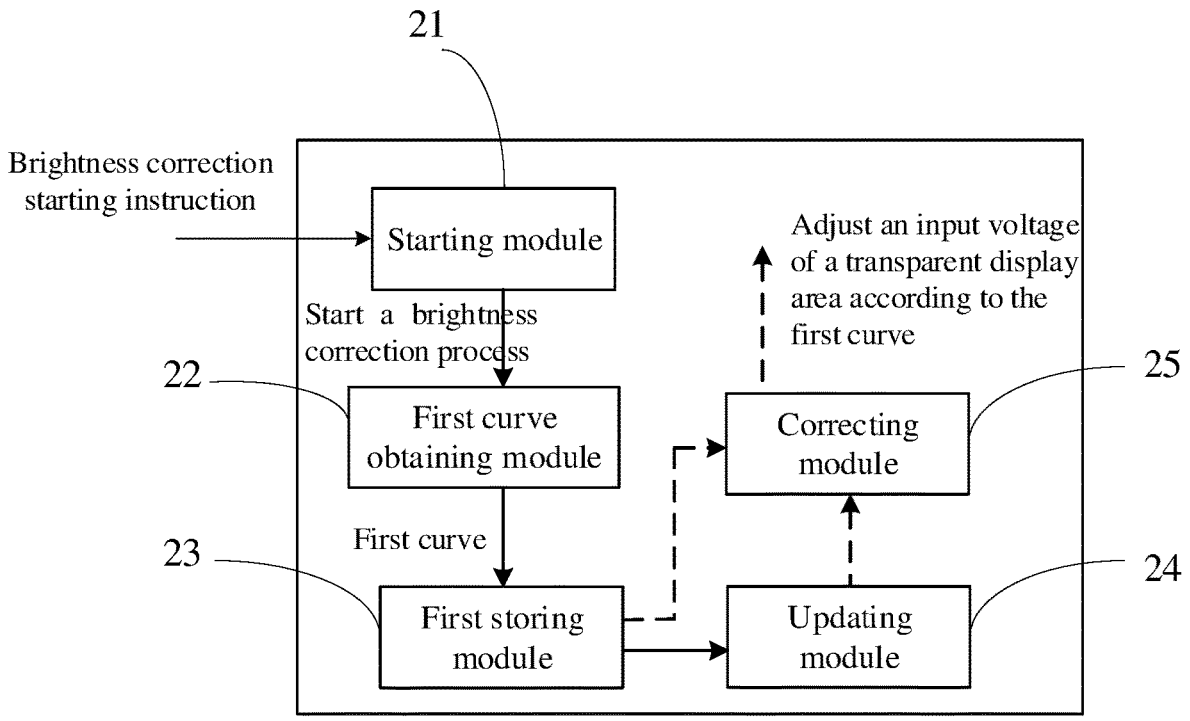
FIG. 8 is a schematic block diagram illustrating an example of an apparatus for correcting brightness of a display panel according to the present application.

In addition, the present application also provides an apparatus for correcting brightness of a display panel. FIG. 8 is a schematic block diagram illustrating an example of an apparatus for correcting brightness of a display panel according to the present application. The display panel may be the display panel 1 as shown in FIGS. 1 and 2. Various modules and apparatus described in the present application may be implemented by circuit, driving circuit and the like.

The apparatus for correcting brightness of the display panel includes a starting module 21, a first curve obtaining module 22, a first storing module 23, an updating module 24 and a correcting module 25. The starting module 21 is configured to start a brightness correction process according to a brightness correction starting instruction. The first curve obtaining module 22 is configured to obtain a first curve representing a relationship between absolute values of input voltages of the transparent display area 10 and light emitting brightness values of the transparent display area in a current state. The first storing module 23 is configured to store the first curve. The updating module 24 is configured to record the first curve as a relationship curve showing a relationship between absolute values of input voltages and light emitting brightness values of the transparent display area for correcting brightness. The correcting module 25 is configured to adjust the input voltage of the transparent display area 10 according to the first curve, so that a front-side light emitting brightness value of the transparent display area 10 is consistent with a light emitting brightness value of the non-transparent display area 11, or the front-side light emitting brightness value of the transparent display area is restored to a factory default brightness value.

Performing brightness correction on the display panel by the apparatus for correcting brightness may reduce or eliminate the difference in brightness between the transparent display area 10 and the non-transparent display area 11, and thereby improve the display effect.

Figure 9:
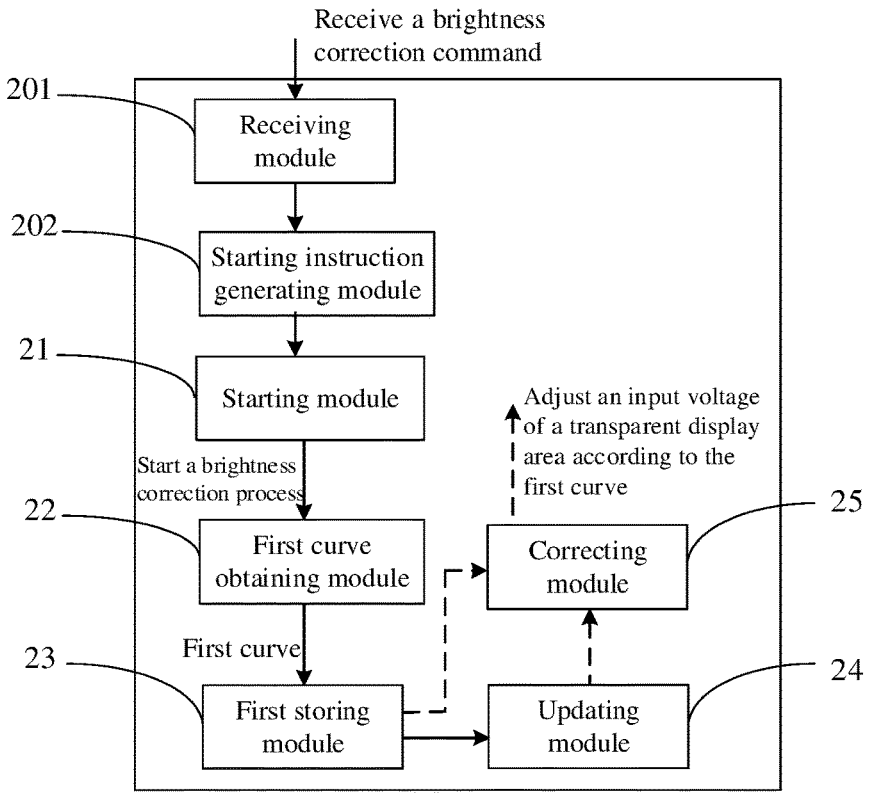
FIG. 9 is a schematic block diagram illustrating an example of an apparatus for correcting brightness of a display panel according to the present application.

In an example, as shown in FIG. 9, the apparatus for correcting brightness of the display panel further includes a receiving module 201 and a starting instruction generating module 202. The receiving module is configured to receive a brightness correction command issued by a user. The starting instruction generating module is configured to generate the brightness correction starting instruction.

Figure 10:
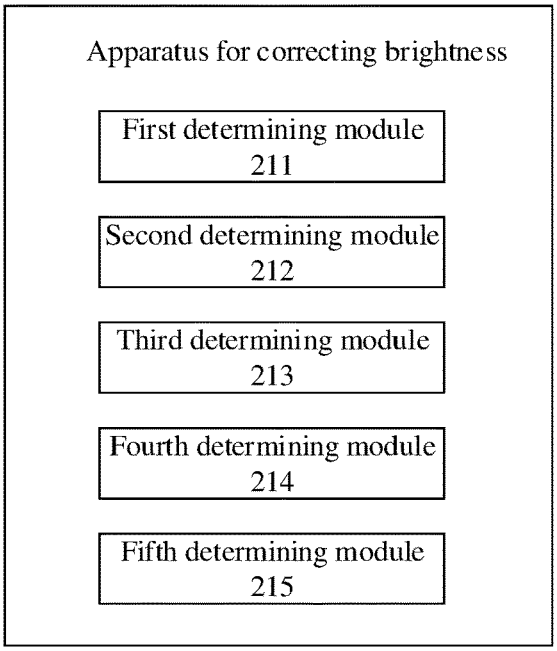
FIG. 10 is a schematic block diagram illustrating an example of an apparatus for correcting brightness of a display panel according to the present application.

In order to obtain determination results of whether preset brightness attenuation requirement is met, whether brightness correction time length requirement is met, whether intensity of ambient light meets a requirement, whether the current time is in an inactive time, whether it is necessary to perform correction, etc. in the method examples, in an example, as shown in FIG. 10, the apparatus for correcting brightness of the display panel further includes a first determining module 211, a second determining module 212, a third determining module 213, a fourth determining module 214 and a fifth determining module 215. The first determining module 211 is configured to determine whether the brightness of the transparent display area 10 meets a preset brightness attenuation requirement in the current state. The second determining module 212 is configured to determine whether a current time length meets a brightness correction time length requirement in a preset brightness correction period. The third determining module 213 is configured to determine an intensity of the ambient light. The fourth determining module 214 is configured to determine whether the current time is an inactive time of user, wherein the inactive time is a period of time after a sleep time of the display panel exceeds a preset threshold, and/or the inactive time is a preset fixed period of time. The fifth determining module 215 is configured to determine whether a first curve representing a relationship between current input voltages of the transparent display area and light emitting brightness values of the transparent display area in the current state needs to be corrected.

Figure 11:
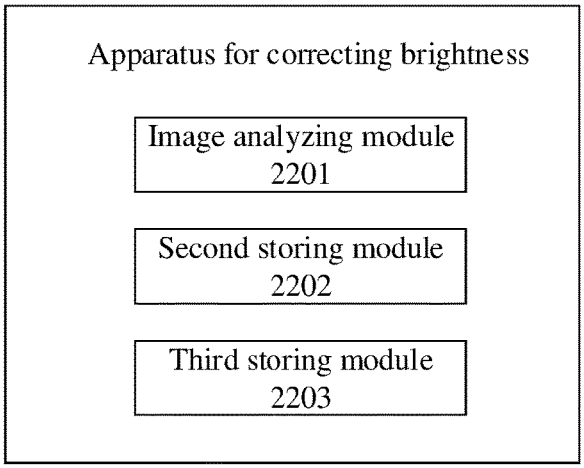
FIG. 11 is a schematic block diagram illustrating an example of an apparatus for correcting brightness of a display panel according to the present application.

In an example, as shown in FIG. 11, the apparatus for correcting brightness of the display panel further includes an image analyzing module 2201, a second storing module 2202 and a third storing module 2203. The image analyzing module 2201 is configured to analyze brightness images of the back side of the transparent display area to obtain the back-side light emitting brightness values of the transparent display area under different input voltages. The second storing module 2202 is configured to store a ratio of the front-side light emitting brightness value to the back-side light emitting brightness value of the transparent display area. The ratio of the front-side light emitting brightness value to the back-side light emitting brightness value in a same transparent display area, under different input voltages, is unique. The third storing module 2203 is configured to store a first curve set. The first curve set is a set of first curves representing relationships between absolute values of input voltages of the transparent display area and light emitting brightness values of the transparent display area in different attenuation states of the display panel, or the first curve set is a set of first curves representing relationships between absolute values of input voltages of the transparent display area and light emitting brightness values of the transparent display area in different attenuation states and corresponding to working time lengths of the display panel.

The apparatus for correcting brightness of the display panel in this example is used to execute the method for correcting brightness of the display panel shown in FIG. 3. For the specific correction implementation process, please refer to the above description. Performing brightness correction on the display panel by the apparatus for correcting brightness may reduce or eliminate the difference in brightness between the transparent display area 10 and the non-transparent display area 11, and thereby improve the display effect.

Figure 12:
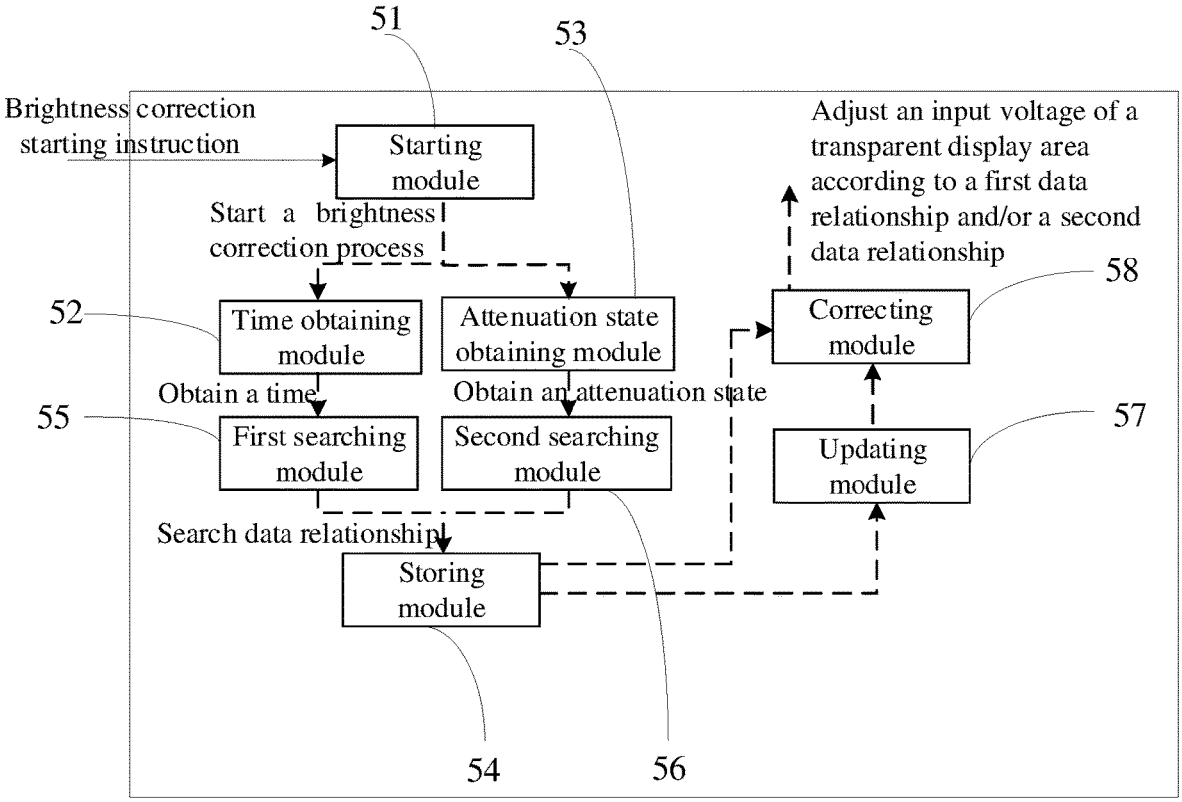
FIG. 12 is a schematic block diagram illustrating another example of an apparatus for correcting brightness of a display panel according to the present application.

The present application also provides an apparatus for correcting brightness of a display panel. FIG. 12 is a schematic block diagram illustrating another example of an apparatus for correcting brightness of a display panel according to the present application. The display panel may be the display panel 1 as shown in FIGS. 1 and 2. The apparatus for correcting brightness includes: a starting module 51, a time obtaining module 52, an attenuation state obtaining module 53, a storing module 54, a first searching module 55, a second searching module 56, an updating module 57 and a correcting module 58. The starting module 51 is configured to start a brightness correction process according to a brightness correction starting instruction. The time obtaining module 52 is configured to obtain a current working time length of the display panel. The attenuation state obtaining module 53 is configured to obtain a current brightness attenuation state of the display panel. The storing module 54 is configured to store a first data relationship set and a second data relationship set. The first data relationship set is a set of pre-stored correspondences between absolute values of input voltages of the transparent display area and light emitting brightness values of the transparent display area in different working time length ranges of the display panel. The second data relationship set is a set of pre-stored correspondences between absolute values of input voltages of the transparent display area and light emitting brightness values of the transparent display area in different attenuation state ranges of the display panel. The first searching module 55 is configured to search a first data relationship corresponding to the current working time length of the display panel from the pre-stored first data relationship set. The second searching module 56 is configured to search a second data relationship corresponding to the current brightness attenuation state of the display panel from the pre-stored second data relationship set. The updating module 57 is configured to record the first data relationship and/or the second data relationship in the current state as a correspondence between an absolute value of an input voltage of the transparent display area and a light emitting brightness value of the transparent display area for correcting brightness. The correcting module 58 is configured to adjust an input voltage of the transparent display area according to the first data relationship and/or the second data relationship, so that a front-side light emitting brightness value of the transparent display area is consistent with a light emitting brightness value of the non-transparent display area, or the front-side light emitting brightness value of the transparent display area is restored to a factory default brightness value.

The apparatus for correcting brightness of the display panel in this example is configured to execute the method for correcting brightness of the display panel shown in FIG. 7. For the specific implementation process, please refer to the above description. Performing brightness correction on the display panel by the apparatus for correcting brightness may reduce or eliminate the difference in brightness between the transparent display area 10 and the non-transparent display area 11, and thereby improve the display effect.

In addition, the present application also provides a display device including a display panel, a photosensitive element 12 and an apparatus for correcting brightness of the display panel. The display panel may be the display panel 1 as described above. The photosensitive element is disposed on a back side of (or below) the transparent display area 10. The photosensitive element 12 may be a camera or a light sensing element, and the number thereof may be one or more. The apparatus for correcting brightness is the apparatus for correcting brightness of the display panel shown in FIG. 8.

Performing brightness correction on the display panel, especially on the transparent display area, by the apparatus for correcting brightness may reduce or eliminate the difference in brightness between the transparent display area 10 and the non-transparent display area 11, and thereby improve the display effect, on the premise of ensuring that the photosensitive element can receive a sufficient amount of light.

The present application also provides a display device including a display panel, and an apparatus for correcting brightness of the display panel. The display panel may be the display panel 1 as described above. The photosensitive element is disposed on a back-side of (or below) the transparent display area 10. The photosensitive element 12 may be a camera or a light sensing element, and the number thereof may be one or more. The apparatus for correcting brightness is the apparatus for correcting brightness of the display panel shown in FIG. 12.

Performing brightness correction on the display panel, especially on the transparent display area, by the apparatus for correcting brightness may reduce or eliminate the difference in brightness between the transparent display area 10 and the non-transparent display area 11, and thereby improve the display effect, on the premise of ensuring that the photosensitive element can receive a sufficient amount of light.

Although the present application is disclosed as above, it is not limited to this. Any person skilled in the art can make various changes and modifications without departing from the spirit and scope of the present application. All kinds of individual embodiments can be implemented in combination, and all kinds of combined embodiments can also be implemented individually to achieve the effects introduced in this application. Therefore, the protection scope of the present application shall be based on the scope defined by the claims.

The invention claimed is:

1. A method for correcting brightness of a display panel, wherein the display panel comprises:

a transparent display area; and a non-transparent display area, wherein the transparent display area is a double-side light emitting display area, a front side of the transparent display area is a side close to ambient light, and a back side of the transparent display area is a side away from the ambient light;

the method for correcting brightness comprises:

starting a brightness correction process according to a brightness correction starting instruction;

obtaining a first curve representing a relationship between absolute values of input voltages of the transparent display area and light emitting brightness values of the transparent display area in a current state;

recording the first curve as a relationship curve showing a relationship between absolute values of input voltages and light emitting brightness values of the transparent display area for correcting brightness; and adjusting an input voltage of the transparent display area according to the first curve, so that a front-side light emitting brightness value of the transparent display area is consistent with a light emitting brightness value of the non-transparent display area, or the front-side light emitting brightness value of the transparent display area is restored to a factory default brightness value, wherein the brightness correction starting instruction is generated based on at least one factor which includes a working time length and an attenuation state of the display panel.

2. The method for correcting brightness of the display panel according to claim 1, wherein the first curve is a gamma curve of the transparent display area in the current state.

3. The method for correcting brightness of the display panel according to claim 2, wherein before starting the brightness correction process according to the brightness correction starting instruction, the method further comprises:

receiving a brightness correction command issued by a user, and generating the brightness correction starting instruction;

after receiving the brightness correction command issued by the user, and generating the brightness correction starting instruction, the method further comprises:

determining whether a light emitting brightness value of the transparent display area in the current state meets a preset brightness attenuation requirement; and in response to determining that the light emitting brightness value of the transparent display area in the current state meets the preset brightness attenuation requirement, starting the brightness correction process according to the brightness correction starting instruction;

after receiving the brightness correction command issued by the user, and generating the brightness correction starting instruction, the method further comprises:

determining whether a current working time length meets a brightness correction time length requirement in a preset brightness correction period; and in response to determining that the current working time length meets the brightness correction time length requirement, starting the brightness correction process according to the brightness correction starting instruction.

4. The method for correcting brightness of the display panel according to claim 2, wherein before starting the brightness correction process according to the brightness correction starting instruction, the method further comprises:

determining whether a light emitting brightness value of the transparent display area in the current state meets a preset brightness attenuation requirement; and in response to determining that the light emitting brightness value of the transparent display area in the current state meets the preset brightness attenuation requirement, generating the brightness correction starting instruction;

before starting the brightness correction process according to the brightness correction starting instruction, the method further comprises:

determining whether a current working time length meets a brightness correction time length requirement in a preset brightness correction period; and in response to determining that the current working time length meets the brightness correction time length requirement, generating the brightness correction starting instruction.

5. The method for correcting brightness of the display panel according to claim 1, wherein before starting the brightness correction process according to the brightness correction starting instruction, the method further comprises:

receiving a brightness correction command issued by a user, and generating the brightness correction starting instruction;

after receiving the brightness correction command issued by the user, and generating the brightness correction starting instruction, the method further comprises:

determining whether a light emitting brightness value of the transparent display area in the current state meets a preset brightness attenuation requirement; and in response to determining that the light emitting brightness value of the transparent display area in the current state meets the preset brightness attenuation requirement, starting the brightness correction process according to the brightness correction starting instruction;

after receiving the brightness correction command issued by the user, and generating the brightness correction starting instruction, the method further comprises:

determining whether a current working time length meets a brightness correction time length requirement in a preset brightness correction period; and in response to determining that the current working time length meets the brightness correction time length requirement, starting the brightness correction process according to the brightness correction starting instruction.

6. The method for correcting brightness of the display panel according to claim 1, wherein before starting the brightness correction process according to the brightness correction starting instruction, the method further comprises:

determining whether a light emitting brightness value of the transparent display area in the current state meets a preset brightness attenuation requirement; and in response to determining that the light emitting brightness value of the transparent display area in the current state meets the preset brightness attenuation requirement, generating the brightness correction starting instruction;

before starting the brightness correction process according to the brightness correction starting instruction, the method further comprises:

determining whether a current working time length meets a brightness correction time length requirement in a preset brightness correction period; and in response to determining that the current working time length meets the brightness correction time length requirement, generating the brightness correction starting instruction.

7. The method for correcting brightness of the display panel according to claim 1, further comprising:

determining an intensity of the ambient light; and in response to determining that the intensity of the ambient light is lower than a preset threshold, generating the brightness correction starting instruction, before generating the brightness correction starting instruction, the method further comprises:

determining whether a current time is an inactive time of user; and in response to determining that the current time is the inactive time of user, generating the brightness correction starting instruction, wherein the inactive time is a period of time after a sleep time of the display panel exceeds a preset threshold, and/or the inactive time is a preset fixed period of time.

8. The method for correcting brightness of the display panel according to claim 1, wherein before starting the brightness correction process according to the brightness correction starting instruction, the method further comprises:

determining whether a first curve representing a relationship between current input voltages of the transparent display area and light emitting brightness values of the transparent display area in the current state is to be corrected; and in response to determining that the first curve is to be corrected, starting the brightness correction process, wherein determining whether the first curve representing the relationship between the current input voltages of the transparent display area and the light emitting brightness values of the transparent display area in the current state is to be corrected comprises:

obtaining reference brightness values corresponding to respective input voltages of the transparent display area in at least high-order, middle-order and low-order grayscale display states;

according to the currently recorded relationship curve representing the relationship between the absolute values of the input voltages and the light emitting brightness values of the transparent display area, determining whether one or more of differences between each of the reference brightness values corresponding to the respective input voltages and a corresponding one of light emitting brightness values corresponding to the respective input voltages in the relationship curve exceeds a preset threshold; and in response to determining that one or more of the differences exceed the preset threshold, the first curve is to be corrected.

9. The method for correcting brightness of the display panel according to claim 1, wherein the light emitting brightness value of the transparent display area is a back-side light emitting brightness value of the transparent display area, or the front-side light emitting brightness value of the transparent display area.

10. The method for correcting brightness of the display panel according to claim 9, wherein, a photosensitive element is provided below the transparent display area;

the first curve represents a relationship between the absolute values of the input voltages of the transparent display area and the back-side light emitting brightness values of the transparent display area;

obtaining the first curve representing the relationship between the absolute values of the input voltages of the transparent display area and the light emitting brightness values of the transparent display area in the current state comprises:

applying different input voltages to pixels in the transparent display area, and obtaining the first curve by obtaining the back-side light emitting brightness values of the transparent display area under different input voltages using the photosensitive element;

obtaining the first curve by obtaining the back-side light emitting brightness values of the transparent display area under different input voltages using the photosensitive element comprises:

using the photosensitive element to take pictures of the back side of the transparent display area being lighted so as to obtain brightness images of the back side of the transparent display area; and obtaining the back-side light emitting brightness values of the transparent display area under the different input voltages by analyzing the brightness images.

11. The method for correcting brightness of the display panel according to claim 9, wherein adjusting the input voltage of the transparent display area according to the first curve comprises:

based on a pre-stored ratio of front-side light emitting brightness value to back-side light emitting brightness value of the transparent display area, and a light emitting brightness value of the non-transparent display area in the current state, obtaining a first back-side light emitting brightness value of the transparent display area corresponding to the front-side light emitting brightness value of the transparent display area consistent with the light emitting brightness value of the non-transparent display area, or a first back-side light emitting brightness value corresponding to the factory default brightness value of the front side of the transparent display area, wherein, the ratio of the front-side light emitting brightness value to the back-side light emitting brightness value in a same transparent display area, under different input voltages, is unique;

determining a first input voltage corresponding to the first back-side light emitting brightness value according to the first curve; and providing the first input voltage for a data line of the transparent display area, so that the front-side light emitting brightness value of the transparent display area is consistent with the light emitting brightness value of the non-transparent display area, or the front-side light emitting brightness value of the transparent display area is restored to the factory default brightness value.

12. The method for correcting brightness of the display panel according to claim 1, wherein, pixels in the transparent display area comprise sub-pixels in n colors, wherein n is a positive integer;

obtaining the first curve representing the relationship between the absolute values of the input voltages of the transparent display area and the light emitting brightness values of the transparent display area in the current state comprises:

applying input voltages simultaneously to the sub-pixels in the n colors in the transparent display area to obtain a plurality of first curves of sub-pixels respectively corresponding to one color of the n colors in a white picture; or obtaining the first curve representing the relationship between the absolute values of the input voltages of the transparent display area and the light emitting brightness values of the transparent display area in the current state comprises:

applying input voltages respectively to the sub-pixels in $n^{th}$ color in the transparent display area, to make the transparent display area display a picture showing the $n^{th}$ color; and obtaining a first curve corresponding to the sub-pixels in the $n^{th}$ color under the $n^{th}$ color picture in an obtaining curve process, and repeating the obtaining curve process until all first curves corresponding to the sub-pixels in the n colors are obtained;

wherein n=3, the pixels in the transparent display area comprise sub-pixels in first color, sub-pixels in second color and sub-pixels in third color, and the sub-pixels in first color, the sub-pixels in second color and the sub-pixels in third color are R sub-pixels, G sub-pixels and B sub-pixels, respectively.

13. The method for correcting brightness of the display panel according to claim 1, wherein obtaining the first curve representing the relationship between the absolute values of the input voltages of the transparent display area and the light emitting brightness values of the transparent display area in the current state comprises:

obtaining a current attenuation state of the display panel; and determining a first curve corresponding to the current attenuation state of the display panel from a pre-stored first curve set, wherein the first curve set is a set of first curves representing relationships between absolute values of input voltages of the transparent display area and light emitting brightness values of the transparent display area in different attenuation states of the display panel.

14. The method for correcting brightness of the display panel according to claim 1, wherein obtaining the first curve representing the relationship between the absolute values of the input voltages of the transparent display area and the light emitting brightness values of the transparent display area in the current state comprises:

obtaining a current working time length of the display panel; and determining a first curve corresponding to the current working time length of the display panel from a pre-stored first curve set, wherein the first curve set is a set of first curves representing relationships between absolute values of input voltages of the transparent display area and light emitting brightness values of the transparent display area in different working time lengths of the display panel.

15. The method for correcting brightness of the display panel according to claim 14, further comprising:

before the display panel leaves a factory, obtaining the first curve set according to an attenuation period and an attenuation state of a light emitting material in the transparent display area, wherein pixels in the transparent display area comprise sub-pixels in n colors, wherein n is a positive integer, and the first curve set comprises first curve subsets respectively corresponding to the sub-pixels in the n colors.

16. A method for correcting brightness of a display panel, wherein the display panel comprises:

a transparent display area; and a non-transparent display area, wherein the transparent display area is a double-side light emitting display area, a front side of the transparent display area is a side close to ambient light, and a back side is a side away from the ambient light;

the method for correcting brightness comprises:

starting a brightness correction process according to a brightness correction starting instruction;

obtaining a current working time length of the display panel and/or a current brightness attenuation state of the display panel;

determining a first data relationship corresponding to the current working time length of the display panel from a pre-stored first data relationship set and/or a second data relationship corresponding to the current brightness attenuation state of the display panel from a pre-stored second data relationship set;

recording the first data relationship and/or the second data relationship as a correspondence between an absolute value of an input voltage and a light emitting brightness value of the transparent display area for correcting brightness, wherein the first data relationship set is a set of pre-stored correspondences between absolute values of input voltages and light emitting brightness values of the transparent display area in different working time length ranges of the display panel, and the second data relationship set is a set of pre-stored correspondences between the absolute values of the input voltages and the light emitting brightness values of the transparent display area in different attenuation state ranges of the display panel; and adjusting an input voltage of the transparent display area according to the first data relationship and/or the second data relationship, so that a front-side light emitting brightness value of the transparent display area is consistent with a light emitting brightness value of the non-transparent display area, or the front-side light emitting brightness value of the transparent display area is restored to a factory default brightness value, wherein the brightness correction starting instruction is generated based on at least one factor which includes the current working time length and the current attenuation state of the display panel.

17. The method for correcting brightness of the display panel according to claim 16, further comprising:

before the display panel leaves a factory, obtaining the first data relationship set and the second data relationship set according to an attenuation period and an attenuation state of a light emitting material in the transparent display area, wherein the first data relationship set and the second data relationship set comprise correspondences between absolute values of respective input voltages and corresponding light emitting brightness values of the transparent display area in at least high-order, middle-order and low-order grayscale display states;

pixels in the transparent display area comprise sub-pixels in n colors, wherein n is a positive integer, and the first data relationship set and the second data relationship set comprise correspondences between absolute values of respective input voltages corresponding to the sub-pixels in respective colors and corresponding light emitting brightness values under a display screen in each color;

wherein n=3, the pixels in the transparent display area comprise sub-pixels in first color, sub-pixels in second color and sub-pixels in third color, and the sub-pixels in first color, the sub-pixels in second color and the sub-pixels in third color are R sub-pixels, G sub-pixels and B sub-pixels, respectively;

determining the first data relationship corresponding to the current working time length of the display panel from the pre-stored first data relationship set comprises:

determining first data relationships corresponding to the current working time length of the display panel and respectively corresponding to sub-pixels in $n^{th}$ color from the pre-stored first data relationship set;

determining the second data relationship corresponding to the current brightness attenuation state of the display panel from the pre-stored second data relationship set comprises:

determining second data relationships corresponding to the current brightness attenuation state of the display panel and respectively corresponding to sub-pixels in $n^{th}$ color from the pre-stored second data relationship set.

18. An apparatus for correcting brightness of a display panel, wherein the display panel comprises:

a transparent display area; and a non-transparent display area, wherein the transparent display area is a double-side light emitting display area, a front side of the transparent display area is a side close to ambient light, and a back side of the transparent display area is a side away from the ambient light;

the apparatus for correcting brightness comprises:

a starting circuit configured to start a brightness correction process according to a brightness correction starting instruction;

a first curve obtaining circuit configured to obtain a first curve representing a relationship between absolute values of input voltages of the transparent display area and light emitting brightness values of the transparent display area in a current state;

a first storing circuit configured to store the first curve;

an updating circuit configured to record the first curve as a relationship curve showing a relationship between absolute values of input voltages and light emitting brightness values of the transparent display area for correcting brightness; and a correcting circuit configured to adjust an input voltage of the transparent display area according to the first curve, so that a front-side light emitting brightness value of the transparent display area is consistent with a light emitting brightness value of the non-transparent display area, or the front-side light emitting brightness value of the transparent display area is restored to a factory default brightness value, wherein the brightness correction starting instruction is generated based on at least one factor which includes a working time length and an attenuation state of the display panel.

19. The apparatus for correcting brightness of the display panel according to claim 18, further comprising:

a receiving circuit configured to receive a brightness correction command issued by a user;

a starting instruction generating circuit configured to generate the brightness correction starting instruction;

a first determining circuit configured to determine whether a light emitting brightness value of the transparent display area in the current state meets a preset brightness attenuation requirement;

a second determining circuit configured to determine whether a current time length meets a brightness correction time length requirement in a preset brightness correction period;

a third determining circuit configured to determine an intensity of the ambient light;

a fourth determining circuit configured to determine whether the current time is an inactive time of the user, wherein the inactive time is a period of time after a sleep time of the display panel exceeds a preset threshold, and/or the inactive time is a preset fixed period of time; and a fifth determining circuit configured to determine whether a first curve representing a relationship between current input voltages of the transparent display area and light emitting brightness values of the transparent display area in the current state is to be corrected.

20. The apparatus for correcting brightness of the display panel according to claim 18, further comprising:

an image analyzing circuit configured to analyze brightness images of the back side of the transparent display area to obtain back-side light emitting brightness value of the transparent display area under different input voltages;

a second storing circuit configured to store a ratio of the front-side light emitting brightness value to the back-side light emitting brightness value of the transparent display area, wherein, the ratio of the front-side light emitting brightness value to the back-side light emitting brightness value in a same transparent display area, under different input voltages, is unique; and a third storing circuit configured to store a first curve set, wherein the first curve set is a set of first curves representing relationships between absolute values of input voltages of the transparent display area and the light emitting brightness values of the transparent display area in different attenuation states of the display panel, or the first curve set is a set of first curves representing relationships between absolute values of input voltages of the transparent display area and the light emitting brightness values of the transparent display area in different working time lengths of the display panel.

* * * * *